US010706672B2

(12) United States Patent
Meunier

(10) Patent No.: US 10,706,672 B2
(45) Date of Patent: Jul. 7, 2020

(54) ACCIDENT DATA RECORDER FOR ELECTRONIC GAMING MACHINES

(71) Applicant: IGT, Las Vegas, NV (US)

(72) Inventor: Yan Meunier, Sackville (CA)

(73) Assignee: IGT, Las Vegas, NV (US)

( * ) Notice: Subject to any disclaimer, the term of this patent is extended or adjusted under 35 U.S.C. 154(b) by 22 days.

(21) Appl. No.: 15/850,319

(22) Filed: Dec. 21, 2017

(65) Prior Publication Data

US 2019/0197825 A1 Jun. 27, 2019

(51) Int. Cl.
*G07F 17/32* (2006.01)
*G07F 17/34* (2006.01)

(52) U.S. Cl.
CPC ..... *G07F 17/3234* (2013.01); *G07F 17/34* (2013.01)

(58) Field of Classification Search
None
See application file for complete search history.

(56) References Cited

U.S. PATENT DOCUMENTS 8,291,025 B2 10/2012 Gupta et al.
8,527,774 B2 9/2013 Fallows et al.
8,602,896 B2 12/2013 Brunet De Courssou
9,558,618 B2 1/2017 Petersen et al.
2003/0032479 A1* 2/2003 LeMay ..... G07F 17/32 463/32
2004/0048669 A1* 3/2004 Rowe ..... G07F 17/32 463/42
2006/0178188 A1* 8/2006 LeMay ..... G07F 17/32 463/16
2008/0171588 A1* 7/2008 Atashband ..... G07F 17/32 463/20
2009/0042640 A1* 2/2009 Gagner ..... G07F 17/32 463/24

* cited by examiner

*Primary Examiner* — Damon J Pierce
(74) *Attorney, Agent, or Firm* — Sage Patent Group

(57) ABSTRACT

A method of generating crash reports by an electronic gaming machine includes detecting an error condition during operation of a wagering game on the EGM, wherein the error condition affects operation of a wagering game executed on the EGM. In response to detecting the error condition, the EGM (a) generates a crash data file comprising data related to the error condition; (b) generates a screenshot of a screen displayed on the display screen at or near a time the error condition was detected; and (c) transmits the crash data file and the screenshot to a central server using a secure communications network to which the EGM and the central server are connected.

18 Claims, 13 Drawing Sheets

ACCIDENT DATA RECORDER FOR ELECTRONIC GAMING MACHINES

BACKGROUND

The present disclosure relates generally to gaming machines, and more particularly to systems and methods for capturing and recording crash data in electronic gaming machines (EGMs).

Many of today's gaming casinos and other entertainment locations feature different single and multi-player gaming systems such as slot machines and video poker machines. The gaming machines may include a number of hardware and software components to provide a wide variety of game types and game playing capabilities. Exemplary hardware components may include bill validators, card readers, keypads, buttons, levers, touch screens, ticket printers, player tracking units and the like. More recently, gaming machines have been equipped with sophisticated gesture recognition hardware, eye gaze tracking systems, and contactless haptic feedback systems that provide an enhanced gaming environment for players. Software components may include, for example, boot and initialization routines, various game play programs and subroutines, credit and payout routines, image and audio generation programs, various component modules and a random or pseudo-random number generator, among others.

More particularly, games played on modern gaming machines are more likely to have a video display interface instead of a mechanical interface, such as a set of mechanical reels. Many newer games include three dimensional displays that display animated three dimensional images to the player, which allow more complex game content to be displayed.

Gaming machines are highly regulated to ensure fairness. In many cases, gaming machines may be operable to dispense monetary awards of a large amount of money. Accordingly, access to gaming machines is often carefully controlled. For example, in some jurisdictions, routine maintenance requires that extra personnel (e.g., gaming control personnel) be notified in advance and be in attendance during such maintenance. Additionally, gaming machines may have hardware and software architectures that differ significantly from those of general-purpose computers (PCs), even though both gaming machines and PCs employ microprocessors to control a variety of devices. For example, gaming machines may have more stringent security requirements and fault tolerance requirements. Additionally, gaming machines generally operate in harsher environments as compared with PCs.

In many casinos and other entertainment locations, the gaming machines may be networked to one or more devices that monitor the functions of the gaming machines during operation. For example, an accounting system may monitor the amount of credits received by a gaming machine and the amount of credits paid out by the gaming machine. Such an accounting system allows the operator of the gaming machines to analyze the profitability of the gaming machines, the use of the gaming machines, and similar metrics.

The operating system of a gaming machine may be configured to use one of a variety of gaming protocols, i.e., communications protocols specifically designed for use in a gaming environment, such as a casino. Such a gaming protocol may be promulgated by an organization that defines standards for the gaming industry. One exemplary protocol is the Slot Accounting System (SAS) Protocol, pioneered by International Game Technology (IGT) and recognized in 2002 by the Gaming Standards Association (GSA) as an industry standard. A more recent communications protocol in the gaming industry is the Game to System (G2S) Protocol, also recognized by the GSA as an industry standard. Thus, many casinos and other gaming environments may have existing infrastructure to communicate data between gaming machines and a server. For example, a server may provide an indication to a gaming machine that the player has won a collective jackpot.

SUMMARY

According to various example embodiments, a method of generating crash reports by an electronic gaming machine is disclosed. The method includes detecting an error condition during operation of a wagering game on the EGM, wherein the error condition affects operation of a wagering game executed on the EGM. In response to detecting the error condition, the EGM (a) generates a crash data file comprising data related to the error condition; (b) generates a screenshot of a screen displayed on the display screen at or near a time the error condition was detected; and (c) transmits the crash data file and the screenshot to a central server using a secure communications network to which the EGM and the central server are connected.

According to further example embodiments, a method of generating crash reports in an electronic gaming machine (EGM) including a display screen includes detecting an error condition during operation of a wagering game on the EGM, wherein the error condition affects operation of a wagering game executed on the EGM; generating an accident data file comprising log data related to the error condition; transmitting a notification to a central server indicating that the accident data file was generated; inserting a screenshot of a screen displayed on the display screen at or near a time the error condition was detected into the accident data file; receiving a command from the central server to transmit the accident data file; and transmitting the accident data file including the screenshot to a central server using a secure communications network to which the EGM and the central server are connected.

The data related to the error condition included in the crash data file may include information describing the game that was being played on the EGM, the identity of the player, the amount of credits available, the amount wagered, the number of paylines being played, the paytable associated with the game, whether a bonus event was triggered, etc. The crash data file may also include information regarding the condition of the EGM at the time of the error, such as the identity of any modules loaded or active processes in memory when the error occurred, the module in which the error occurred, the state of registers, the name of a core dump stored in the EGM in response to the error condition, the operating system version, etc.

Generating the screenshot may include generating a plurality of screenshots showing different screen data displayed on the display screen at different times near the time the error condition was detected.

At least one of the plurality of screenshots may include screen data displayed before the error condition was detected. In some embodiments, screenshot data may be continuously recorded in a buffer as the wagering game is played. When the buffer is full, screenshot data may be discarded if an error condition has not been detected at or near the time the screenshot data was captured. When an error is detected, the screenshot data may thereby include screenshot data showing the state of the game for a period of time before the error was detected.

The stored screenshot data may be discarded upon conclusion of an instance of the wagering game if an error condition was not detected in association with the instance of the wagering game.

At least one of the screenshots in the screenshot data may display a final outcome of an instance of the wagering game that was executing when the error condition occurred.

The screenshot may include a video, a 3D rendering or a 2D rendering displayed on the display screen during an instance of the wagering game that was executing when the error condition occurred.

Generating the screenshot may include rendering a flat 2D view of a 3D scene displayed on the display screen.

A log of screenshot data associated with an instance of the wagering game may be generated, and the log of screenshot data may be transmitted to the central server.

The crash data file and the screenshot data may be transmitted to the central server using the game to system, G2S, communication protocol message structure.

In some embodiments, when the crash data file and screenshot data are generated, the EGM may trigger a G2S_DLE301 Module Added event. The EGM may transmit the G2S_DLE301 Module Added event to the central server.

In some embodiments, the G2S_DLE301 Module Added event may be triggered after triggering of a G2S_GPE112 Game Ended event.

The method of Claim 8, further comprising triggering a G2S_ADE201 Screenshot Capture Created event after generating the screenshot and transmitting the G2S_ADE201 Screenshot Capture Created event to the central server.

When the EGM detects the error condition, the EGM may store the crash data file and the screenshot in nonvolatile storage prior to transmitting the crash data file and the screenshot to the central server.

The EGM may notify the central server of the error condition. The central server may issue a command to the EGM to generate the log data and the screenshot in response to the error condition. The EGM then generates the crash data file and the screenshot in response to the command from the central server.

In some embodiments, game outcome logs may be generated and stored for all instances of wagering games executed on the EGM regardless of whether an error condition occurred in a given instance of the wagering game.

When an error is detected in the operation of the wagering game, the EGM triggers a G2S_ADE100 event.

A method of generating crash reports in an electronic gaming machine (EGM) according to further embodiments includes detecting an error condition during operation of a wagering game on the EGM, wherein the error condition affects operation of a wagering game executed on the EGM; generating an accident data file comprising log data related to the error condition; triggering a G2S_DLE301 Module Added event in response to generating the accident data file and transmitting the G2S_DLE301 Module Added event to a central server using a game-to-system communication protocol message structure over a secure communications network to which the EGM and the central server are connected; generating a screenshot of a screen displayed on a display screen of the EGM at or near a time the error condition was detected; triggering a G2S_ADE201 Screenshot Capture Created event after generating the screenshot and transmitting the G2S_ADE201 Screenshot Capture Created event to the central server; inserting the screenshot into the accident data file; receiving a command from the central server to transmit the accident data file; and transmitting the accident data file including the screenshot to the central server.

BRIEF DESCRIPTION OF THE DRAWINGS

The details of one or more implementations are set forth in the accompanying drawings and the description below. Other features, aspects, and advantages of the disclosure will become apparent from the descriptions, the drawings, and the claims, in which:

DETAILED DESCRIPTION

Figure 1:
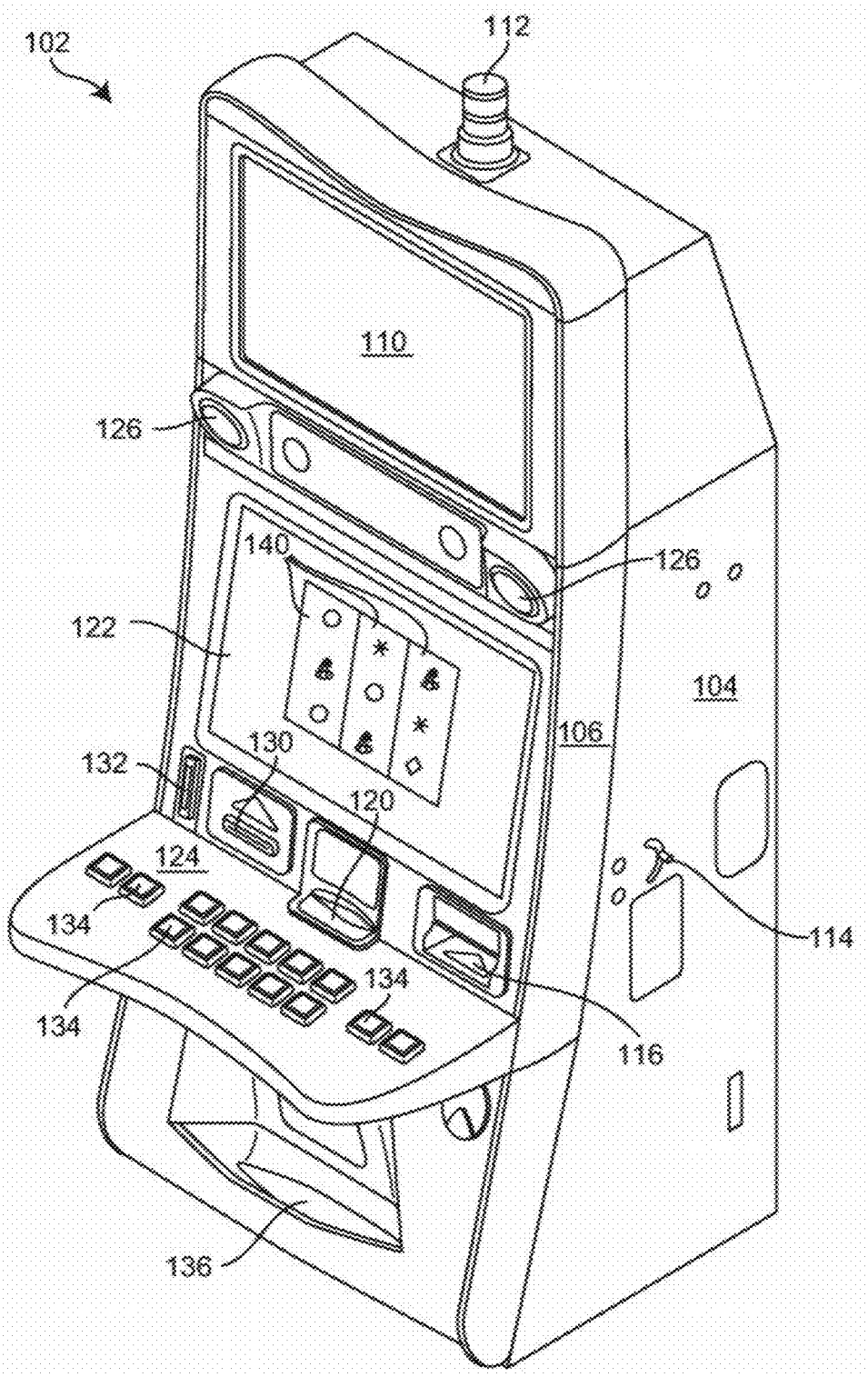
FIG. 1 is an illustration of a gaming machine, according to some embodiments.

Numerous specific details may be set forth below to provide a thorough understanding of concepts underlying the described embodiments. It may be apparent, however, to one skilled in the art that the described embodiments may be practiced without some or all of these specific details. In other instances, some process steps have not been described in detail in order to avoid unnecessarily obscuring the underlying concept.

As noted above, in many casinos and other entertainment locations, the gaming machines may be networked to one or more devices that monitor the functions of the gaming machines during operation, which allows the operator of the gaming machines to collect and analyze data relating to the operation of the games.

One exception to this is in the collection of accident data. Accident data refers to data relating to the functioning of an electronic gaming machine in the event of a malfunction of some aspect of the functioning of the gaming machine during operation of a wagering game on the machine. Currently, in the event of a malfunction, the gaming machine halts operation and may store diagnostic log information. A technician must come to the location of the machine and manually download any data stored by the machine, typically in the form of a core dump. Such data must then be manually carried, for example on a USB memory stick, to a back office, where it can be analyzed to determine what error occurred. Such actions are costly and time consuming. Moreover, with modern gaming machines, such as gaming machines including 2D or 3D displays that display animated content, it may be difficult and time consuming to recreate the condition of the gaming machine when the error occurred so that issues relating to the operation of the game can be identified and/or disputes about the outcome can be promptly resolved.

According to various embodiments disclosed herein, Accidental Data Recorder (ADR) functionality is provided to address one or more of these problems. The ADR functionality described herein includes a set of GSA Game-to-System (G2S) based commands, events and actions at the EGM level that enables communication between a back-end host system, such as the INTELLIGEN system manufactured by IGT, and EGM platform software for the purpose of gathering diagnostic log files present on an EGM in the event of an error and transferring the files to the host system for analysis and failure resolution. Previously, it was necessary for diagnostic log files to be manually copied from the affected EGM to a storage device such as a flash drive by a field technician at the gaming site, loaded onto another host system, and finally transferred to the EGM vendor for analysis and resolution. Such actions are costly, time consuming and prone to human error if complete crash data is not collected.

The casino industry is heavily regulated by regulating entities, such as the Nevada Gaming Control Board and others. Regulators require casino operators to comply with extensive regulations covering the operation of EGMs, including requiring operators to maintain records of the operation of the EGM. Collection of crash data may be required by a regulator, and as such, there is a need for casino operators to quickly and accurately collect and store information about machine crashes. Even apart from regulation, there is a need for casino operators to quickly collect accurate and complete information about a machine malfunction, as there is a high likelihood that a player of the EGM when it crashed will have questions about the crash and whether it caused the player to lose any funds stored or wagered on the machine. By collecting and forwarding crash information to a central server automatically, a casino operator may be better equipped to handle customer inquiries regarding the crash. In that regard, automatic reporting of crash data performs a function that cannot be easily performed by hand since, as noted above, hand collection of crash data may be costly, time consuming and error prone.

G2S (Game-to-System) is a communication protocol that connects an EGM, such as a slot machine or a video lottery terminal (VLT) to a host system, which is typically a back-end server operated by a casino operator. This protocol enables software download, remote configuration, and remote software verification, which are completely new features for the class III gaming industry.

G2S defines multiple classes, each of which is responsible for supporting a specific function, such as voucher, cabinet, printer, communications, handpay, etc. Each of these classes has specific commands and responses to support the function described in the class name. Moreover, each class has an owner host. These hosts may be separate and distinct servers, may all be owned by a single owner host or may be any combination thereof.

G2S also supports the concept of a guest host, which is a host that can issue commands and subscribe to events but cannot control the function of the class. Another unique feature of G2S is ability to set up authorizing hosts. These hosts may be registered with the EGMs and when a change in software or configuration is requested, the authorizing hosts must specifically allow the change to occur or the change times out and fails (the change is not made). This feature, along with the remote software verification, provides significant capabilities to gaming regulators and casino operators who want to make sure they know what is on the casino floor.

G2S also has a unique subscription service that allows host systems to subscribe to events that occur on an EGM. The subscription service allows a host system to subscribe to only the events, and therefore the information, that it needs to accomplish its function. It doesn't have to sift through all the information on the floor.

By subscribing to events, a host can track an EGM through all the steps of every process it undertakes. The host can also ask for all the data (meter changes, status, errors, etc.) associated with the event or can just receive the event as a notification.

Some embodiments of the inventive concepts operate by capturing log data associated with error conditions that occur during operation of the EGM, and in particular during operation of an instance of a wagering game on the EGM. When an error condition is detected, the error condition is reported to the central server. The error condition may be an error condition in the operation of an instance of a wagering game on the EGM, and/or with other software modules operating on the EGM, such as accounting system modules, user management modules, audit modules, or any other monitored software modules operating on the EGM. Such software modules are generally referred to herein as "monitored applications."

The EGM may automatically, upon detection of an error condition in one of the monitored applications, or in response to server commands, capture error log data, such as debug logs, core dumps, and persistent game data files, and screenshots captured at or near the occurrence of the error condition. Such data may be referred to herein as "ADR data." The EGM may further, automatically and/or in response to a server command, transmit the captured data to the central server over a secure communication interface. Prior to transmitting the ADR data, the EGM may store the ADR data in a nonvolatile storage and trigger an identified G2S event to notify the central server of the availability of the data. It will be appreciated that ADR data may be captured in response to an error condition occurring in any of the monitored applications, and not only in response to an error condition in the operation of the wagering game itself.

One or more screenshots of images displayed on a primary and/or secondary display unit of the EGM may be captured and included as part of the ADR data. The captured screenshot(s) may include still images and/or video, and may include 2D representations of 3D images that were displayed on a display unit of the EGM. At least one screenshot may be provided that reproduces a screen that shows the outcome of a game instance that was executing on the EGM when the error condition occurred. The capturing of screenshots and generation of ADR data is described in more detail below.

G2S Protocol Description

G2S is a message-oriented protocol that may be implemented in a gaming environment. In general, a message-oriented protocol allows applications to subscribe to various topics managed by a message broker. A message posted by an application to a topic may be broadcast by the message broker to any applications subscribed to the topic. In some embodiments, a message-oriented protocol may be used within a gaming machine to allow different applications on the machine to communicate. For example, a first application on the gaming machine may communicate with a second application on the gaming machine by posting a message to a topic. If the second application is subscribed to the topic, the second application may then receive the posted message. In further embodiments, an application on a gaming machine may communicate with an application on a remote device (e.g., another gaming machine, a server, etc.) using the message-oriented protocol. For example, a central server may be configured to maintain an accounting of received funds and payouts from a deployed gaming machine by subscribing to one or more related topics. Whenever the gaming machine receives funds from a player or pays out to a player, it may post to the one or more topics, so that the server receives the message. In some embodiments, a message sent via the message-oriented protocol may be wrapped in a gaming protocol, such as G2S, when sent between a gaming machine and another device in the gaming environment.

Referring to FIG. 1, a perspective drawing of an electronic gaming machine 102 is shown in accordance with described embodiments. Gaming machine 102 may include a main cabinet 104. Main cabinet 104 may provide a secure enclosure that prevents tampering with device components, such as a game controller (not shown) located within the interior of main cabinet 104. Main cabinet 104 may include an access mechanism, such as a door 106, which allows the interior of gaming machine 102 to be accessed. Actuation of a door 106 may be controlled by a locking mechanism 114. In some embodiments, locking mechanism 114, door 106, and the interior of main cabinet 104 may be monitored with security sensors of various types to detect whether the interior has been accessed. For instance, a light sensor may be provided within main cabinet 104 to detect a change in light-levels when door 106 is opened and/or an accelerometer may be attached to door 106 to detect when door 106 is opened.

Gaming machine 102 may include any number of user interface devices that convey sensory information to a user and/or receive input from the user. For example, gaming machine 102 may include electronic displays 110, 122, speakers 126, and/or a candle device 112 to convey information to the user of gaming machine 102. Gaming machine 102 may also include a console 124 having one or more inputs 134 (e.g., buttons, track pads, etc.) configured to receive input from a user. In one embodiment, display 110 and/or display 122 may also be a touch screen display configured to receive input from a user. A controller (not shown) within gaming machine 102 may run a game, such as a wager-based game, in response to receiving input from a user via inputs 134, display 122, or display 110. For example, inputs 134 may be operated to place a wager in the game and to run the game. In response, the controller may cause reels shown on display 122 to spin, such as with a software-based slot game.

Gaming machine 102 may also include devices for conducting a wager-based game. For example, gaming machine 102 may include a physical value acceptor, such as a ticket/bill acceptor 116, and a printer 120. In various embodiments, gaming machine 102 may be configured to run on credits that may be redeemed for money and/or other forms of prizes. Ticket acceptor 116 may read an inserted ticket having one or more credits usable to play a game on gaming machine 102. For example, a player of gaming machine 102 may wager one or more credits within a video slot game. If the player loses, the wagered amount may be deducted from the player's remaining balance on gaming machine 102. However, if the player wins, the player's balance may be increased by the amount won. Any remaining credit balance on gaming machine 102 may be converted into a ticket via printer 120. For example, a player of gaming machine 102 may cash out of the machine by selecting to print a ticket via printer 120. The ticket may then be used to play other gaming machines or redeemed for cash and/or prizes. According to various embodiments, gaming machine 102 may record data regarding its receipt and/or disbursement of credits. For example, gaming machine 102 may generate accounting data whenever a result of a wager-based game is determined. In some embodiments, gaming machine 102 may provide accounting data to a remote data collection device, allowing the remote monitoring of gaming machine 102.

In one embodiment, gaming machine 102 may include a loyalty card acceptor 130. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing gaming machine 102. For example, a user having a loyalty account may be given a bonus turn on gaming machine 102 or credited loyalty points for playing gaming machine 102. Such loyalty points may be exchanged for loyalty rewards (e.g., a free meal, a free hotel stay, free room upgrade, discounts, etc.).

Figure 2:
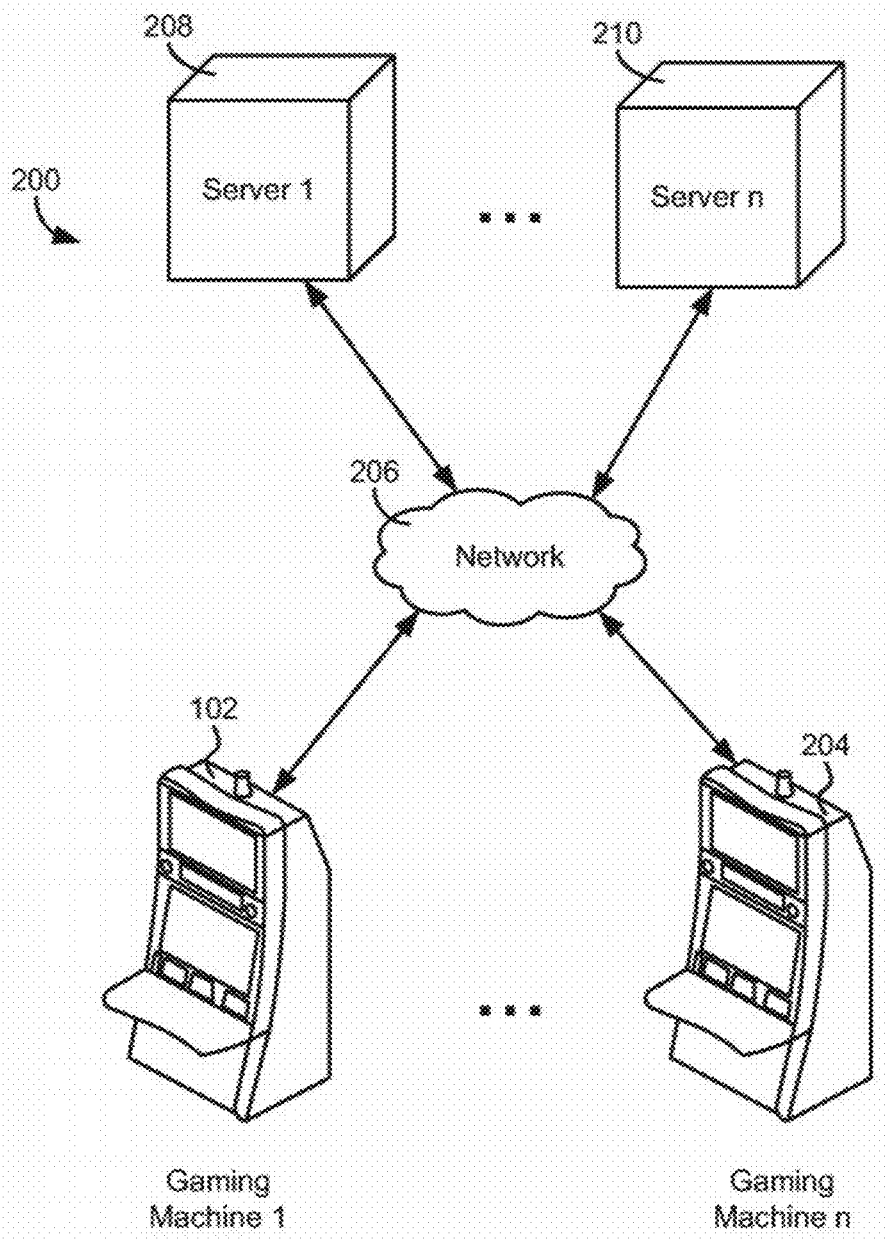
FIG. 2 is an illustration of a gaming environment, according to some embodiments.

Referring now to FIG. 2, an illustration of a gaming environment 200 is shown, according to an exemplary embodiment. Gaming environment 200 may be within, for example, a casino, a racetrack, a hotel, or other entertainment location. As shown, gaming environment 200 may include any number of gaming machines. For example, gaming environment 200 may include gaming machine 102 shown in FIG. 1 through a gaming machine 204 (i.e., a first gaming machine through nth gaming machine). Gaming environment 200 may also include any number of remote servers and other devices, such as servers 208 through server 210 (e.g., a first server through nth server). Gaming environment may further include a network 206 through which gaming machines 102, 204 and servers 208, 210 communicate.

Network 206 may be any form of communications network that conveys data between gaming machines 102, 204 and servers 208, 210. In one embodiment, network 206 may also convey data between gaming machines 102, 204. For example, gaming machines 102, 204 may be gaming machines that execute a particular type of game that allows for social gaming (e.g., a player of gaming machine 102 may coordinate some of his or her in-game actions with the player of gaming machine 204, to achieve certain collaborative goals, bonuses, etc.). Network 206 may include any number wired or wireless connections, in various embodiments. For example, server 208 may communicate with server 210 over a wired connection that includes a serial cable, a fiber optic cable, a CAT5 cable, or any other form of wired connection. In another example, server 208 may communicate with gaming machine 102 via a wireless connection (e.g., via WiFi, cellular, radio, etc.). Network 206 may also include any number of local area networks (LANs), wide area networks (WANs), or the Internet. For example, gaming machine 208 may communicate with server 210 via a casino's LAN connected to the Internet. Accordingly, network 206 may include any number of intermediary networking devices, such as routers, switches, servers, etc.

Servers 208, 210 may be one or more electronic devices connected to network 206 configured to collect data from gaming machines 102, 204 and/or provide data to gaming machines 102, 204. For example, servers 208, 210 may be single computers, a collection of computers, or data centers. Servers 208, 210 may include one or more data storage devices in communication with one or more processors. The data storage devices may store machine instructions that, when executed by the one or more processors, cause the one or more processors to perform the functions described with regard to servers 208, 210. Generally, servers 208, 210 may be configured to receive and store data regarding gaming machines 102, 204 and to provide data to gaming machines 102, 204. In some cases, servers 208, 210 may perform data analysis on the received data. For example, one or more of servers 208, 210 may determine averages, trends, metrics, etc., for one or more of gaming machines 102, 204. Data may be sent between gaming machines 102, 204 and servers 208, 210 in real-time (e.g., whenever a change in credits or cash occurs, whenever another type of system event occurs, etc.), periodically (e.g., every fifteen minutes, every hour, etc.), or in response to receiving a message from one of the devices.

In various embodiments, servers 208, 210 and gaming machines 102, 204 may utilize a gaming protocol, such as G2S or SAS, to communicate via network 206. Such a gaming protocol may include security features to ensure the integrity of communications between the devices in gaming environment 200. For example, a communication between gaming machine 102 and server 208 using G2S may be encrypted using a secure socket layer (SSL) encryption technique. The communication may then be decrypted by the receiving device, thereby ensuring the integrity of the communicated data.

The data communicated between servers 208, 210 and gaming machines 102, 204 may include accounting data. Accounting data may be, but is not limited to, data indicative of credits received or paid out by gaming machines 102, 204. Servers 208, 210 may process the collected accounting data and generate one or more reports regarding the financial state of gaming machines 102, 204 (e.g., the amount of money that a gaming machine has generated or lost, the amount of use of the gaming machine by players, which games were played on the machine, etc.). The data communicated between servers 208, 210 and gaming machines 102, 204 may also include operational data. In general, operational data may be any other form of data indicative of the operational state of gaming machines 102, 204. For example, operational data may include data indicative of the number of games played on gaming machines 102, 204, the types of games played on gaming machines 102, 204, errors or alerts generated by gaming machines 102, 204, and/or whether gaming machines 102, 204 are currently in use, etc. Servers 208, 210 may use the received operational data to allow gaming machines 102, 204 to be monitored. Servers 208, 210 may also provide notifications if maintenance is required for any of gaming machines 102, 204. For example, a notification may be sent to a display (e.g., a display attached to server 208, a display of a handheld device operated by a technician, etc.), so that an error may be corrected.

A messaging-oriented protocol may be implemented in one or more of the devices in gaming environment 200. As used herein, a message-oriented protocol refers to any messaging protocol that allows applications to subscribe or publish messages to a topic. Sometimes referred to as message-oriented middleware (MOM), a message-oriented protocol may use a message broker application to coordinate and maintain the receiving and transmitting of messages. Such a message broker may be implemented at one or more of the devices in gaming environment 200. In one embodiment, the messaging-oriented protocol used in gaming environment 200 may be, or may be based on, the Simple Text Oriented Messaging Protocol (STOMP). Under STOMP, messages may be sent in text-based frames containing various commands (e.g., CONNECT, SUBSCRIBE, SEND, etc.). Since the messages are text-based, the messaging-protocol may be independent of the various programming languages and system types used in gaming environment 200.

Figure 3:
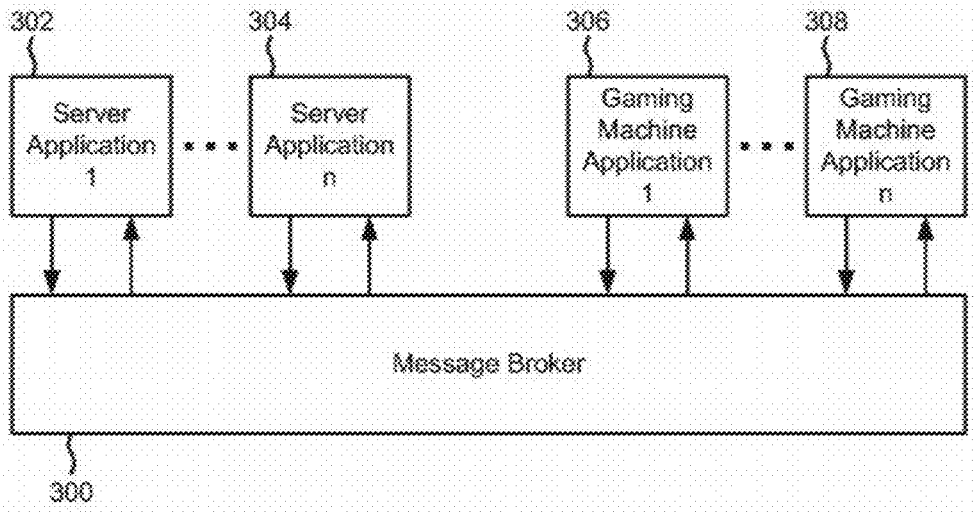
FIG. 3 is a block diagram of a message broker, according to some embodiments.

Referring now to FIG. 3, a block diagram of a message broker 300 of a messaging protocol is shown, according to one embodiment. As shown, message broker 300 may be implemented in a gaming environment, such as gaming environment 200 shown in FIG. 2. Any number of applications running on the various machines of a gaming environment may communicate via message broker 300. For example, server applications 302, 304 (e.g., a first through nth server application) and gaming machine applications 306, 308 (e.g., a first through nth gaming machine application) may communicate via message broker 300. Applications 302-308 may be any form of software applications or processes configured to send messages via a message-oriented protocol. Message broker 300 may be a software and/or hardware module configured to manage the delivery of messages among applications 302-308. Message broker 300 may be implemented at any of the devices executing applications 302-308 or may be implemented at a different device in communication with the other devices. Since the message broker 300 handles the passing of messages, messages may be sent in a bi-directional manner between any of applications 302-308.

In some embodiments, message broker 300 may be configured to operate in a hub-and-spoke manner where message delivery depends on the availability of message broker 300. In one embodiment, message broker 300 may maintain any number of message queues for different topics. Exemplary actions that may be performed by applications 302-308 via message broker 300 may include, but are not limited to, the creation of topics, publishing a message to a topic, subscribing to a topic, acknowledging receipt of a message, and unsubscribing from a topic. For example, server application 302 may publish a message to a particular topic managed by message broker 300. In response, message broker 300 may deliver the message to any of applications 302-308 that are subscribed to the topic.

In an alternate embodiment, message broker 300 may be a message BUS that does not require a single message broker to disseminate messages to topic subscribers. Instead, a message may be broadcast by one of applications 302-308 and received by the other applications. If the receiving application is subscribed to the topic of the message, the receiving application may process the message. For example, application 302 may post a message to the message BUS regarding a particular topic. The message may then be received by one or more of applications 304-308. If application 308, for example, is subscribed to the topic, it may process the message.

Since the message-oriented protocol used by message broker 300 is system and language independent, messages communicated between applications 302-308 may be wrapped using a particular communication protocol, such as a gaming protocol. For example, message broker 300 may handle messages that conform to the message-oriented protocol, STOMP. A text-based message conforming to STOMP may be generated by one of applications 302-308 and transmitted by its respective device using G2S to the device executing message broker 300. At the receiving device, the G2S communication may be unwrapped into the original STOMP message and processed by message broker 300. If the message is to be delivered to another local application on the device that executes message broker 300, message broker 300 may deliver the message using STOMP. However, if the message is to be delivered to an application on a remote device, the device executing message broker 300 may similarly convert the STOMP message into the G2S format and transmit it to the remote device.

It will be appreciated that a message broker service is not required to process G2S messages exchanged between servers 208, 210 and EGMs 104, 204, but that a message broker service may be used for convenience and ease of development/implementation.

Figure 4A:
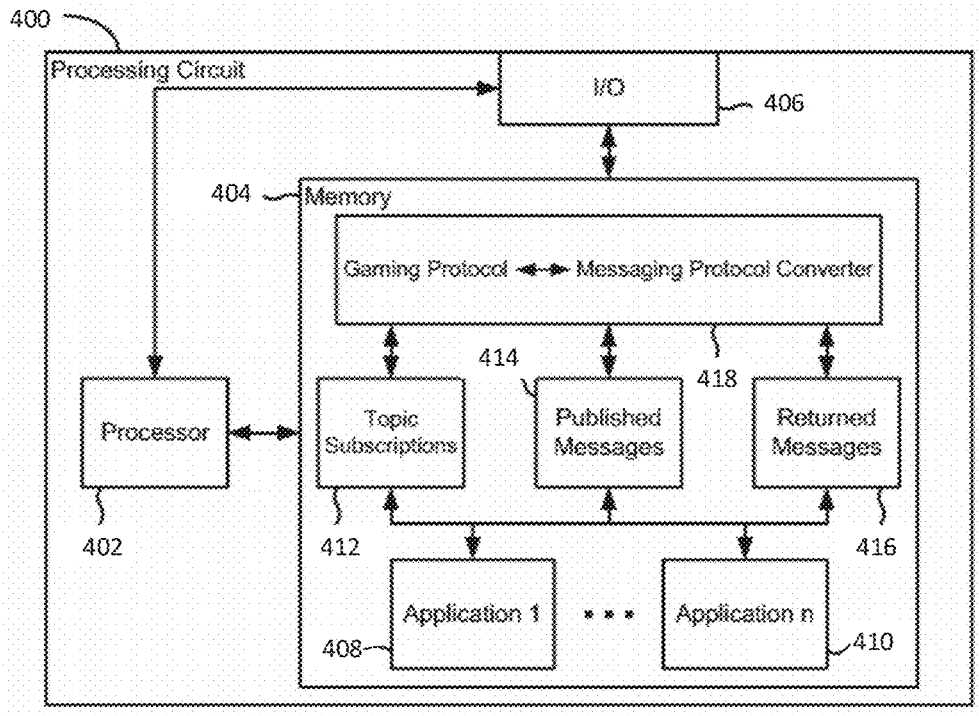
FIG. 4A is a block diagram of a processing circuit, according to some embodiments.

Referring now to FIG. 4A, a block diagram of a processing circuit 400 is shown, according to an exemplary embodiment. Processing circuit 400 may be a processing component of any electronic device used as part of a gaming environment. For example, any of servers 208, 210 or gaming machines 102, 204 shown in FIG. 2 may include processing circuit 400. In another embodiment, processing circuit 400 may be part of a computing system that includes multiple devices. In such a case, processing circuit 400 may represent the collective components of the system (e.g., processors, memories, etc.).

Processing circuit 400 may include a processor 402 and a memory 404. Memory 404 stores machine instructions that, when executed by processor 402, cause processor 402 to perform one or more operations described herein. Processor 402 may include a microprocessor, FPGA, ASIC, any other form of processing electronics, or combinations thereof. Memory 404 may be any electronic storage medium such as, but not limited to, a floppy disk, a hard drive, a CD-ROM, a DVD-ROM, a magnetic disk, RAM, ROM, EEPROM, EPROM, flash memory, optical memory, or combinations thereof. Memory 404 may be a tangible storage medium that stores non-transitory machine instructions. Processing circuit 400 may include any number of processors and memories. In other words, processor 402 may represent the collective processing devices of processing circuit 400 and memory 404 may represent the collective storage devices of processing circuit 400. Processor 402 and memory 404 may be on the same printed circuit board or may be in communication with each other via a bus or other form of connection.

I/O hardware 406 includes the interface hardware used by processing circuit 400 to receive data from other devices and/or to provide data to other devices. For example, a command may be sent from processing circuit 400 to a controlled device of gaming machine 102 via I/O hardware 406. I/O hardware 406 may include, but is not limited to, hardware to communicate on a local system bus and/or on a network. For example, I/O hardware 406 may include a port to transmit display data to an electronic display and another port to receive data from any of the devices connected to network 206 shown in FIG. 2.

Processing circuit 400 may store applications 408-410 in memory 404 (e.g., a first through nth application) for execution by processor 402, according to various implementations. Applications 408-410 may include executable code for one or more thick or thin client games. Thick client games generally refer to gaming applications that include all of the logic and graphics for a game. Thin client games, in contrast, generally refer to gaming applications in which the game logic is executed on a remote device and provided to another device running a thin client. For example, the game logic may be executed on a server and graphics representing the outcome of the game may be provided to a gaming machine for display within a thin client (e.g., Adobe Flash or another such application). Applications 408-410 may also include, but are not limited to, executable applications that perform accounting functions (e.g., tracking the amount of money or credits received by a gaming machine and paid out by a gaming machine), loyalty-related functions (e.g., tracking the wagered amounts by a player, tracking the amount of game time played by the player, by crediting the player's loyalty account with loyalty points, etc.), hospitality-related functions (e.g., allowing a player to make reservations for a show or restaurant, allowing a player to request a favorite drink, etc.), operation-related functions (e.g., tracking operational errors of a gaming machine), and other functions. In particular embodiments, the applications 408-410 include an accident reporting function that reports accident data to a server 208, 210.

One or more of applications 408, 410 may be configured to communicate with other applications via a message-oriented protocol. Exemplary message-oriented protocols include, but are not limited to, STOMP, the Extensible Messaging and Presence Protocol (XMPP), and the Advanced Message Queuing Protocol (AMQP). The message-oriented protocol may be implemented with or without a message broker, in various embodiments. For example, application 408 may send a message via the message-oriented protocol to a message broker stored locally in memory 404 or on another device via I/O hardware 406.

In various embodiments, the message-oriented protocol may use a publish-subscribe messaging format. In such a format, the application sending a message does not designate the endpoint receivers of the message. Instead, the message may be published to a topic. Applications subscribed to the topic may then receive the published message. Thus, message communication between applications may be scalable without requiring changes to the code of the applications (e.g., a message may be communicated to any number of other applications by subscribing the other applications to the corresponding topic).

Applications 408, 410 may generate commands and receive messages via the message-oriented protocol. In one or more of applications 408, 410 may generate topic subscriptions 412 to subscribe to a particular topic. For example, application 408 may be a gaming application (e.g., a slot game) that subscribes to a loyalty-related topic managed by a message broker. One or more of applications 408, 410 may also generate published messages 414 that are published to topics managed by the message broker. If a message is published to one of the topics in topic subscriptions 412, the message broker may send one or more returned messages 416 to the subscribing application. For example, application 408 may receive a loyalty-related message from a remote server, if application 408 is subscribed to a loyalty-related topic managed by the message broker. Other communicated commands (not shown) may include requests to unsubscribe from topics, message receipt confirmations, and requests to connect or disconnect from a message broker.

In one embodiment, memory 404 may include a gaming protocol↔messaging protocol converter 418. Gaming protocol↔messaging protocol converter 418 may be configured to convert any of topic subscriptions 412, published messages 414 into conformity with a gaming protocol. The converted topic subscriptions 412 and published messages 414 may be wrapped in a gaming protocol, such as G2S and sent to another device via I/O hardware 406 (e.g., the device executing the message broker). Similarly, processing circuit 400 may receive returned messages 416 sent using the gaming protocol. In such a case, gaming protocol↔messaging protocol converter 418 may convert the communication from the gaming protocol into the format of the message-oriented protocol and provide the message to one of applications 408, 410.

Accident Data Recording

As noted above, Accident Data Recorder (ADR) functionality is provided to address one or more of these problems. The ADR functionality described herein includes a set of GSA Game-to-System (G2S) based commands and actions at the EGM level that enables communication between a back-end host system, such as the INTELLIGEN system manufactured by IGT, and EGM platform software for the purpose of gathering diagnostic log files present on an EGM in the event of an error and transferring the files to the host system for analysis and failure resolution. Previously, diagnostic log files had to be manually copied from the affected EGM to a data recording device such as a flash drive by a field technician at the gaming site, loaded onto another host system, and finally transferred to the EGM vendor for analysis and resolution.

Figure 4B:
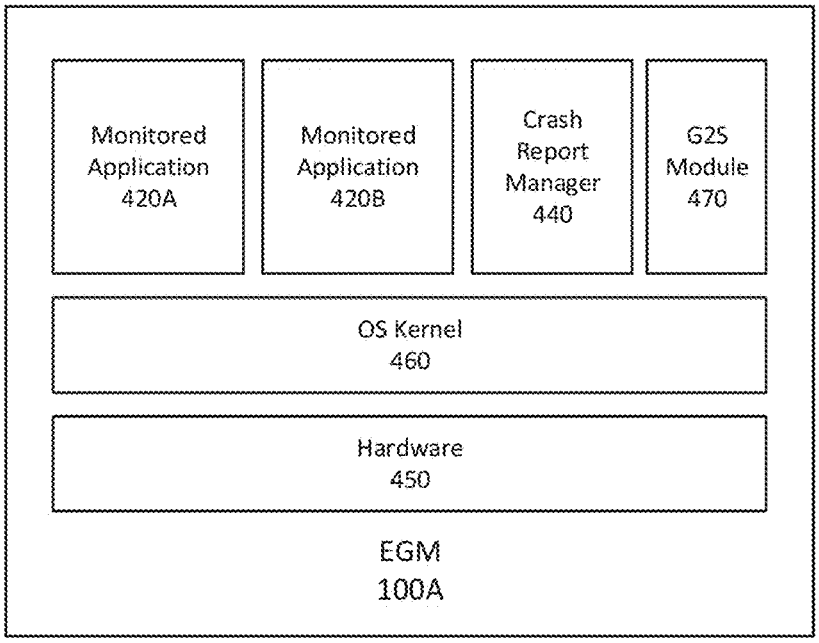
FIGS. 4B and 4C are diagrams illustrating logical arrangements of software components of EGMs according to various embodiments.

ADR functionality may be performed by a G2S module operating as a service in the EGM. From an architectural standpoint, the G2S module may reside adjacent the monitored applications where it can communicate directly with the monitored applications using an application programming interface, as illustrated in FIG. 4B, which is a block diagram illustrating functional modules of an EGM 100A. As shown therein, the EGM 100A includes a hardware section 450, which includes hardware and other circuitry such as a central processing unit (CPU), random access memory (RAM), storage devices, such as a hard drive, CD-ROM, etc., I/O equipment such as a display screen and keyboard, and a network adapter. An operating system (OS) kernel 460 interfaces directly with the hardware section 450, and provides services, such as process management, memory management, file system management, device management and network management. To support these services, the OS kernel 460 may include a scheduler, a memory manager, a file system manager, network drivers, display drivers, device drivers, and network protocol stacks.

Various software modules are operated on top of the OS kernel, including one or more monitored applications 420A, 420B, a crash report manager module 440 and a G2S module 470. The G2S module 470 provides G2S based communication services to other modules. The crash report manager module 420 generates ADR data as described herein and transmits the ADR data to a central server using the services of the G2S module 470.

In this configuration, the monitored applications 420A, 420B and/or the crash report manager module 440 may trigger G2S events, for example, by using the messaging-oriented protocol described above. The operating system may include, for example, a Linux or Windows based operating system.

Figure 4C:
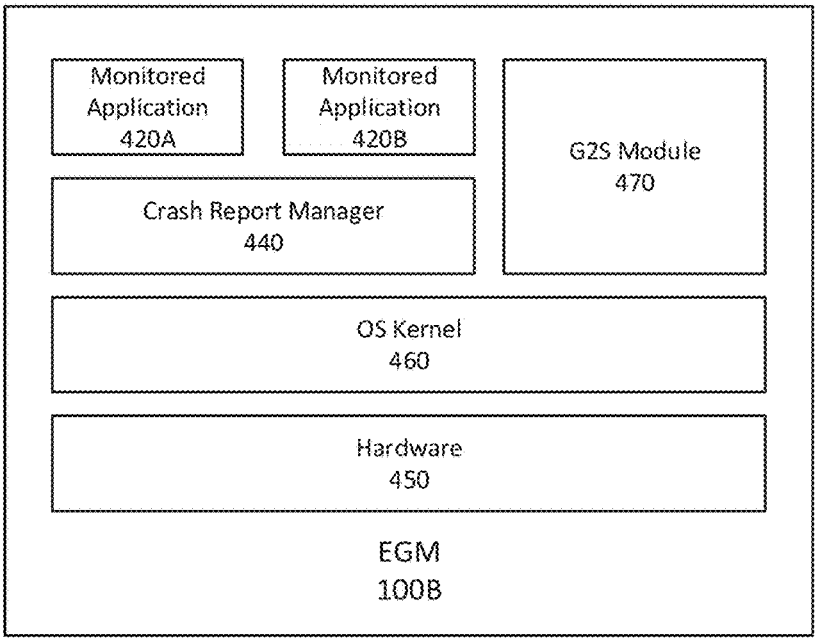

In some embodiments, at least some ADR functionality may be provided by a crash report manager module 440 that is provided as a separate layer between the monitored applications and the OS kernel 460 where the crash report manager module 440 can monitor the health of the monitored applications, as illustrated in FIG. 4C. In this configuration, the crash report manager module 440 triggers G2S events by communicating with the G2S module 470 using the messaging-oriented protocol described above. Moreover, the monitored applications may themselves trigger G2S events by communicating with the G2S module 470 using the messaging-oriented protocol described above.

Some embodiments of the inventive concepts operate by capturing log data associated with error conditions that occur during operation of the EGM, and in particular during operation of an instance of a wagering game on the EGM. When an error condition is detected, the error condition is reported to a central server that is typically managed and operated by a game operator, such as a casino. The error condition may be an error condition in the operation of a monitored application, which may include an instance of a wagering game on the EGM, and/or other software modules operating on the EGM, such as accounting system modules, user management modules, audit modules, etc.

The crash report manager module 440 and/or a monitored application 420A, 420B may automatically, upon detection of an error condition in one of the monitored applications, or in response to server commands, capture ADR data, including error log data, such as debug logs, core dumps, and persistent game data files, and screenshots captured at or near the occurrence of the error condition. In some embodiments, the crash report manager module 440 may further, automatically and/or in response to a server command, transmit the captured data to the central server over a secure communication interface.

In still further embodiments, the crash report manager module 440 and/or a monitored application 420A, 420B may construct ADR data files and transmit the ADR data files to the central server and/or to a remote site. In particular, it will be appreciated that ADR data may be generated for multiple purposes. For example, one purpose of generating the ADR data is for the game operator to have data indicating the state of a game in the event of a crash for auditing, accounting and/or regulatory purposes. Such data is referred to herein as "ADR audit data." ADR audit data may include, for example, data that is required by a regulatory agency to be maintained by a game operator and/or any other data that a game operator may desire to save.

Another purpose for generating ADR data is to assist the game operator in resolving disputes with a patron in the event of the occurrence of an error condition during game play. To help resolve such disputes in a timely fashion, it is desirable for the game operator to quickly have access to information showing the state of the game at the time the error occurred, including information such as how many credits were available, what player was playing the game (based on, for example, player profile information obtained from a player's loyalty card), how many credits were last wagered, whether any credits were withdrawn by the player, etc. Such data is referred to herein as "ADR game data."

Yet another purpose for collecting ADR data is to assist a game manufacturer in identifying and debugging programming errors that may have caused the error condition to occur. Such information is referred to herein as "ADR debug data." ADR debug data may include, for example, core dump data, active module lists, log data, etc., that is useful for debugging programming errors, including runtime errors. It will be appreciated that the game operator may not be able to interpret, understand or use ADR debug data, as the ADR debug data may relate to and/or describe the internal operation of the monitored application(s). That is, the ADR debug data may only be useful to the manufacturer of the EGM, and as such, the ADR debug data may contain or embody proprietary information relating to the design of the EGM and/or the monitored applications.

As will be described in more detail below, different types of ADR data, such as ADR game data, ADR audit data and ADR debug data may, in some embodiments, be handled differently by the EGM.

Prior to transmitting the ADR data, the crash report manager module and/or a monitored application may store the ADR data in a nonvolatile storage and trigger an identified G2S event to notify the central server of the availability of the data. It will be appreciated that ADR data may be captured in response to an error condition occurring in any of the monitored applications, and not only in response to an error condition in the operation of the wagering game itself.

Figure 5:
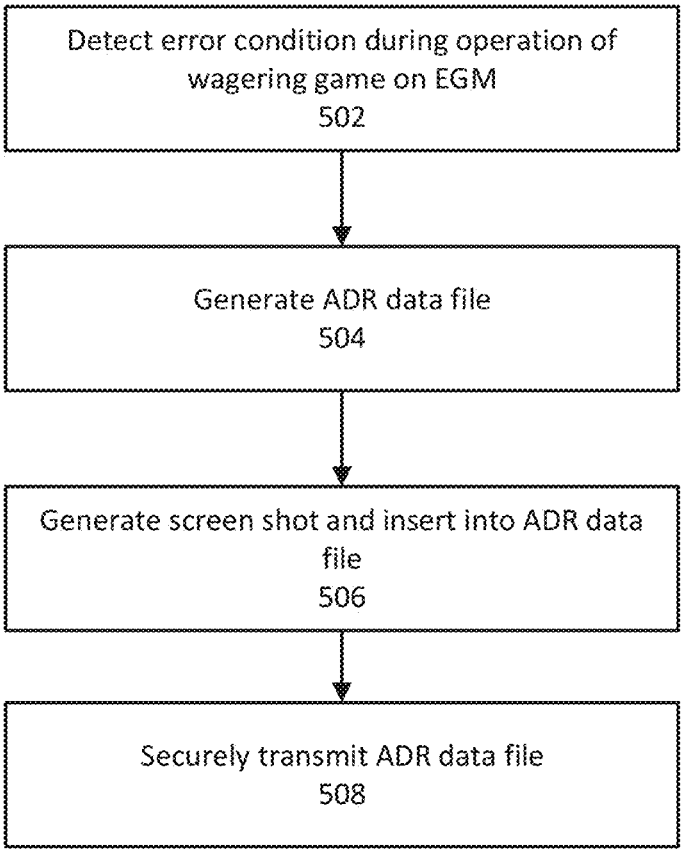
FIG. 5 is a flowchart illustrating operations of systems/methods according to some embodiments.

Referring to FIG. 5, a method of generating crash reports in an electronic gaming machine (EGM) according to some embodiments is illustrated. The method includes detecting an error condition during operation of a wagering game on the EGM, wherein the error condition affects operation of a wagering game executed on the EGM (block 502). In response to detecting the error condition, the EGM (a) generates an ADR data file including data related to the error condition (block 504); (b) generates a screenshot of a screen displayed on the display screen at or near a time the error condition was detected and inserts the screenshot into the ADR data file (block 506); and (c) transmits the ADR data file including the screenshot, for example, to a central server using a secure communications network to which the EGM and the central server are connected (block 508).

The data related to the error condition included in the crash data file may include information describing the game that was being played on the EGM, the identity of the player, the amount of credits available, the amount wagered, the number of paylines being played, the paytable associated with the game, whether a bonus event was triggered, etc. The crash data file may also include information regarding the condition of the EGM at the time of the error, such as the identity of any modules loaded or active processes in memory when the error occurred, the module in which the error occurred, the state of registers, the contents of nonvolatile memory, the name of a core dump stored in the EGM in response to the error condition, the operating system version, etc.

G2S Events

G2S is an event-driven protocol in that communications between an EGM and a central server are related to G2S events that are triggered in the central server or the EGM. When an event is triggered, a message including an event code for the event is transmitted from the EGM to the central server or vice-versa. G2S defines a number of existing events, such as:

TABLE 1

Partial List of Existing G2S Events

| Event Code | Event Description |
|---|---|
| G2S_DLE301 | Module Added |
| G2S_GPE112 | Game Ended |
| G2S_GPE103 | Primary game play started |
| G2S_GPE105 | Primary game play ended |
| G2S_GPE109 | Secondary game play started |
| G2S_GPE110 | Secondary game play ended |
| G2S_GE113 | Game idle |
| G2S_CBE201 | Comms issue EGM disabled |
| G2S_CBE201 | EGM disabled - operator menu |
| G2S_CBE204 | Host command disabled EGM |

It will be appreciated that there are many more events defined in the G2S protocol.

Embodiments of the inventive concepts provide new, previously undefined, G2S events that relate to the capture, storage, retrieval, transmission and deletion of ADR data, which may be referred to as "crash reports." For example, embodiments of the inventive concepts define the following new G2S events:

TABLE 2

New G2S Events

| Event Code | Event Description |
|---|---|
| G2S_ADE100 | System Failure Detected |
| G2S_ADE101 | ADR Data Capture Created |
| G2S_ADE102 | ADR Data Capture Deleted |
| G2S_ADE103 | ADR Data Capture Available |
| G2S_ADE104 | ADR Data Capture Aborted |
| G2S_ADE201 | Screenshot Capture Created |
| G2S_ADE202 | Screenshot Capture Deleted |
| G2S_ADE203 | Screenshot Capture Available |
| G2S_ADE204 | Screenshot Capture Aborted |
| G2S_ADE001 | Device Disabled by EGM |
| G2S_ADE002 | Device Not Disabled by EGM |
| G2S_ADE003 | Device Disabled by Host |
| G2S_ADE004 | Device Not Disabled by Host |
| G2S_ADE005 | Device Configuration Changed by Host |
| G2S_ADE006 | Device Configuration Changed by Operator |

When the crash report manager module and/or a monitored application detects a failure or other error condition in a monitored application, crash report manager module and/or the monitored application may trigger a G2S_ADE100 event by sending a message using the messaging-oriented protocol described above to the G2S module. The G2S module then transmits the G2S_ADE100 event to the central server, informing the central server that a system failure has been detected. Other events are provided to allow the crash report manager module and/or a monitored application to notify a central server when an ADR data capture is created, deleted or available, or when a previously initiated ADR data capture has been aborted. Similarly, new events are provided to allow the crash report manager module and/or a monitored application to notify a central server when an screenshot capture is created, deleted or available, or when a previously initiated screenshot capture has been aborted.

ADR Report Generation

Figure 6:
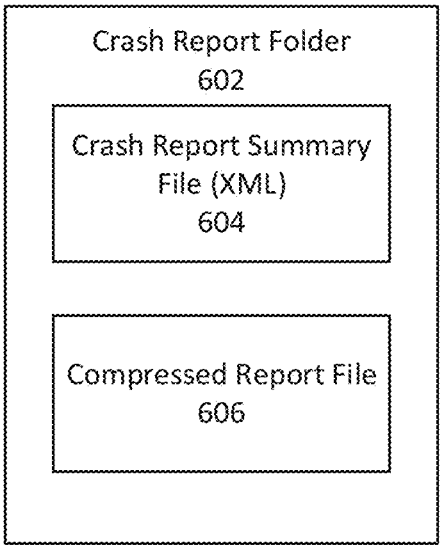
FIG. 6 is a block diagram illustrating contents of a crash report folder according to some embodiments.

For a system management component, such as a protocol or a back office screen, to be able to make use of the information provided in the ADR data, a standard data structure may be provided for ADR reports. For example, each crash report may be placed into a separate folder for storage and/or transmission. This facilitates the management of crashes, and keeping file names consistent for any one crash report. Referring to FIG. 6, a crash report folder 602 is illustrated. Each crash report folder 602 include a crash report summary file 604 (in the form of an XML file) and a compressed report file 606.

Figure 7:
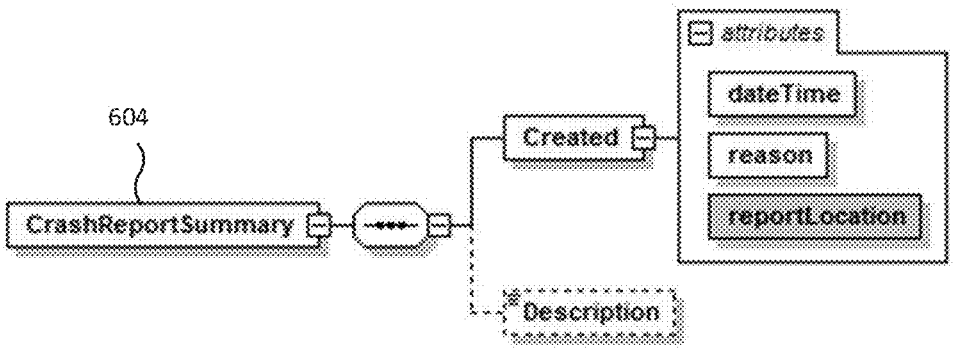
FIG. 7 illustrates contents of a crash report summary XML file according to some embodiments.

The structure of the crash report summary file 604 is illustrated in more detail in FIG. 7, and may have the contents shown in Table 3, below.

TABLE 3

Crash Report Summary File

| Attribute | Restriction | Description |
|---|---|---|
| dateTime | Type: xs:dateTime<br>Use: required | Date and time of the generation of the report |
| Reason | Type: t_reasonTypes<br>Use: required | Reason of the generation of the report: onCrash<br>onSystemFailure<br>onDemand |
| reportLocation | Type: xs:anyURI<br>Use: required | URI location of the report |

The crash report summary file 604 contains the date and time stamp of when the crash occurred. The crash report summary file 604 also includes the location of the compressed report itself, and an optional description of what occurred.

Programmatically this allows a system manager component to search through the crash report root folder to find all crashes. The component can read the crash report summary files to obtain information that allows the component to manage and use the information to display to a user, or for a protocol to report the information to a central system.

The compressed report file 606 may be compressed using any suitable compression algorithm, such as the tar compression algorithm, the zip compression algorithm or other algorithm. The compressed report file 606 may include information that may be useful to allow a developer to investigate the crash, such as the contents of non-volatile memory in the EGM, the content of the log partition or any other pertinent crash data file, and the crash report summary file.

Figure 8:
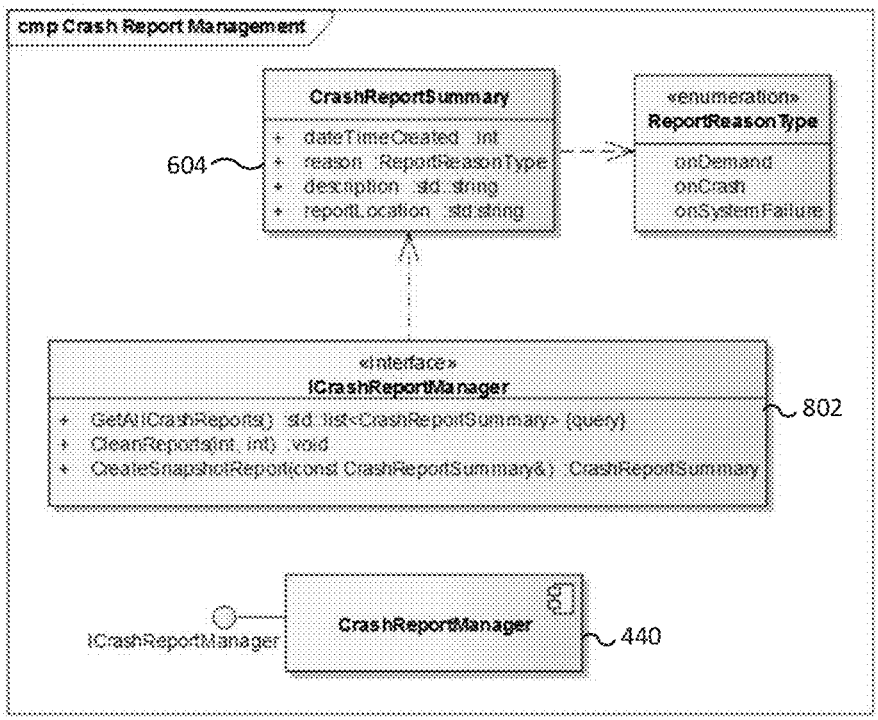
FIG. 8 illustrates the generation of a crash report by a crash report manager module according to some embodiments.

Referring to FIG. 8, to facilitate the management of the crash reports, a crash report manager interface 802 can be used to retrieve, create and clean up crash reports for a crash report manager module 804. The implementation of this interface may be done in such a way that is not dependent on other components other than standard libraries so as to allow the component to be loaded with minimum requirements, such as being used by the crash application.

Figure 9:
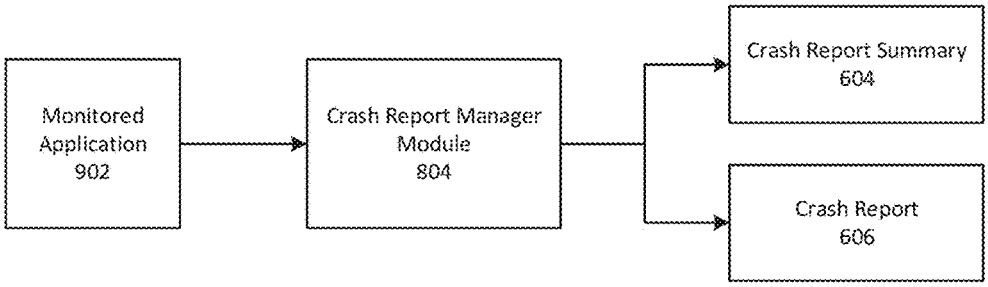
FIG. 9 is a block diagram illustrating the generation of a crash report by a crash report manager module according to some embodiments.

FIG. 9 illustrates the generation of a crash report summary 604 and a crash report 606, which together constitute an ADR report, by a crash report manager module 804 based on information received from a monitored application 902.

Figure 10:
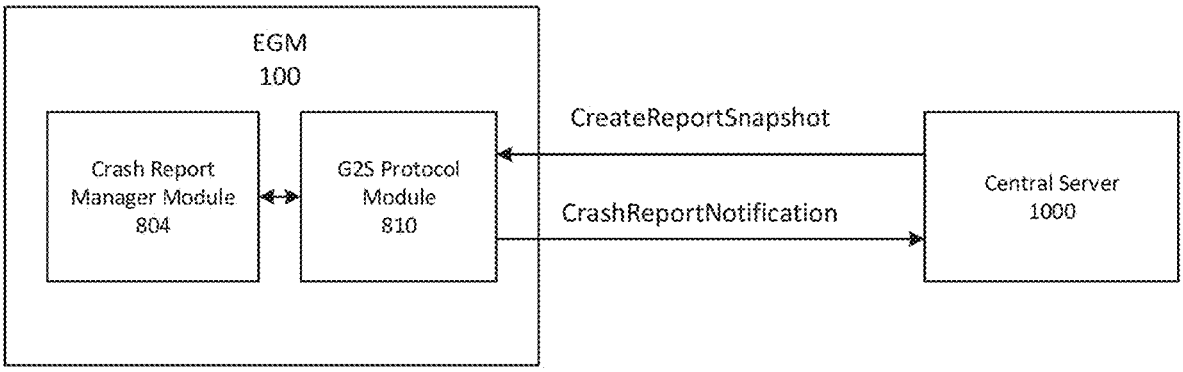
FIG. 10 is a block diagram illustrating a system including an EGM And a central server according to some embodiments.

ADR reports may be generated by the crash report manager module 804 and/or the monitored application 902 in some embodiments. In some embodiments, ADR reports may additionally be generated on demand in response to an instruction from the central server. On demand generation of ADR reports in response to a request from a central server 820 is illustrated in FIG. 10. As shown therein, a central server 1000 may issue a CreateReportSnapshot command and transmit the command using the G2S interface to an EGM 100. The G2S message is processed by the G2S protocol module and forwarded to the crash report manager module 804. A crash report is generated by the crash report manager module 804 and transmitted back to the central server using the G2S protocol in a CrashReportNotification message.

This functionality allows other components, such as a back office screen or a central server to capture a report while the monitored application is running. This provides an extension to a crash report and would be located in a separate folder and would not require to be power safe.

For on demand reports, more items can be added to what exists within the file system which is captured by the crash application, including items such as generated status reports on running components that record game states, protocol states, EGM details, etc.

In some embodiments, when the ADR data file is generated, the crash report manager module 804 may trigger a G2S_DLE301 Module Added event. The crash report manager module 804 may transmit the G2S_DLE301 Module Added event to the central server. In some embodiments, the G2S_DLE301 Module Added event may be triggered after triggering of a G2S GPE112 Game Ended event.

When the crash report manager module 804 detects the error condition, the crash report manager module 804 may store the ADR data file in nonvolatile storage prior to transmitting the ADR data file to the central server 1000 and/or prior to initiating a reboot of the EGM.

According to some embodiments, in an object-oriented programming environment, an application programming interface for utilizing ADR functionality may include a new class that exposes some configurable items to control the crash application. Such items may include a configuration for a number of archived logs, a flag to allow auto clean up by the EGM of older reports, a configuration for the life of a crash report, etc.

The class may also allow a remote host to listen to events to be notified when a crash report is generated, either on power recovery after a crash or in an event of a system failure when the protocol layer is still running.

This class may allow a remote host to query the existing reports that have already been generated by the crash report manager module and request that a report to be uploaded to a remote location. The class may also allow a host to generate reports on demand, which may be useful in a case where run time issues need to be investigated.

Figure 11:
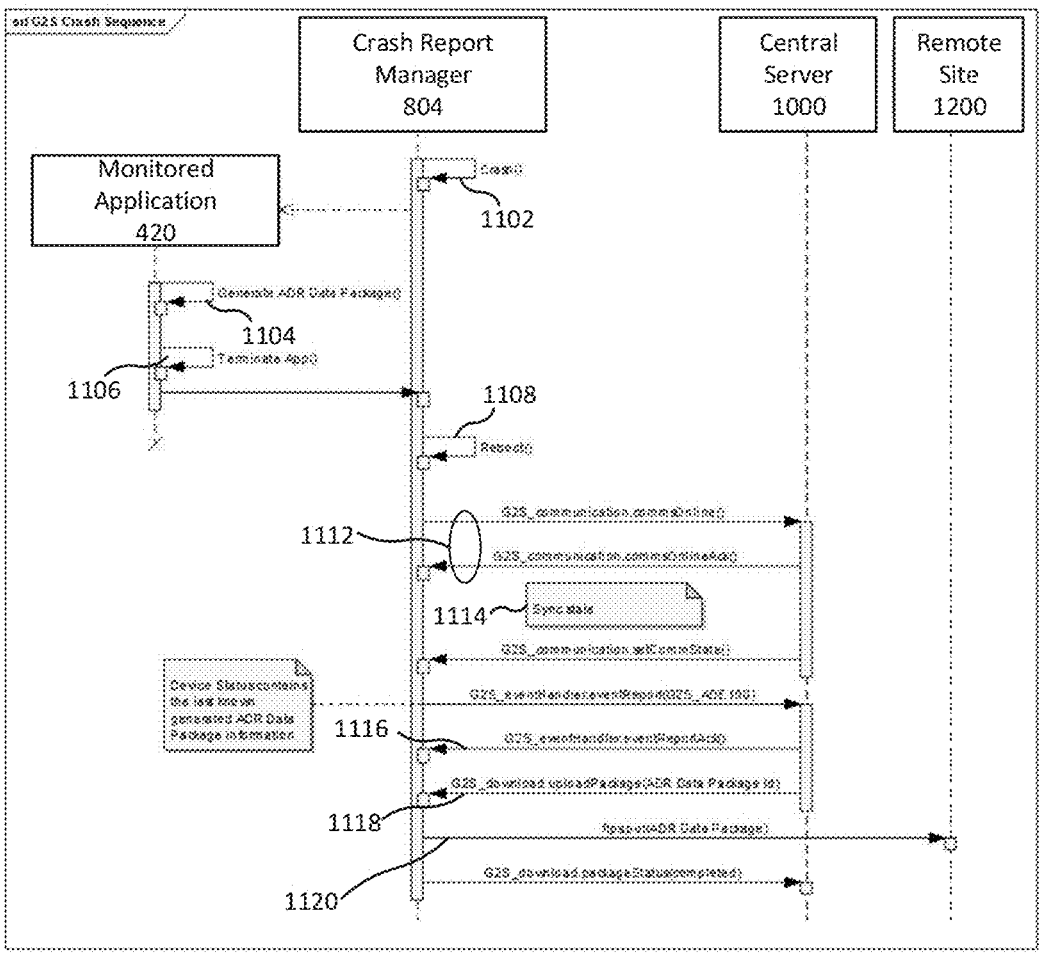
FIG. 11 is a flow diagram illustrating the generation of a crash report by a crash report manager module according to some embodiments.

An example of a flow sequence in the event of a crash of a monitored application is illustrated in FIG. 11. As shown therein, a crash report manager 804 detects that a monitored application 420 has crashed (block 1104). In the example illustrated in FIG. 11, error handling code in the monitored application generates an ADR report when an error is detected (block 1104). It will be appreciated that block 1104 could be performed in some embodiments by the crash report manager module 804. The monitored application 420 then terminates operation (block 1106) and notifies the crash report manager module 804 of program termination.

Upon program termination of the monitored application 420, the crash report manager module 804 requests a reboot of the system (block 1108). Following reboot, the crash report manager module 804 reestablishes G2S communications with a central server 1000 (block 1112) that is located on a secure network with the EGM 100 and synchronizes its state with the central server 1000 (block 1114).

The crash report manager module 804 then triggers a G2S event, namely a G2S_ADE100 event to report that a system failure was detected (block 1116). In this example, the central server 1000 transmits a message 1118 instructing the crash report manager module 804 to upload the ADR report to a remote site 1200 using a secure file transfer protocol (sftp). In response, the crash report manager module 804 transmits the ADR report to the remote site 1200 using a secure file transfer protocol (block 1120) and reports the transmission to the central server 1000. It will be appreciated that in another example, the central server 1000 may instruct the crash report manager module 804 to transmit the ADR report to the central server 1000 using, for example, a secure communication protocol, such as secure hypertext transfer protocol, or https. The remote site 1200 may, for example, be a server operated by a manufacturer of the EGM 100 to allow the manufacturer to quickly analyze the crash, determine its cause, and provide any necessary patch or update to address the crash.

ADR Data Segmentation, Encryption and Signing

As noted above, the crash report manager module 804 and/or a monitored application 420 may construct ADR data files and transmit the ADR data files to the central server and/or to a remote site. The ADR data files may include different types of data, including ADR audit data including data indicating the state of a game that is in the event of a crash that is stored for auditing, accounting and/or regulatory purposes. ADR game data showing the state of the game at the time the error occurred, including information such as how many credits were available, what player was playing the game, how many credits were last wagered, whether any credits were withdrawn by the player, etc., that may be useful to the game operator for resolving disputes, and ADR debug data that may assist a game manufacturer in identifying and debugging programming errors that may have caused the error condition to occur, including information such as core dump data, active module lists, log data, etc.

As further noted above, the ADR debug data may only be useful to the manufacturer of the EGM, and as such, the ADR debug data may contain or embody proprietary information relating to the design of the EGM and/or the monitored applications.

Figure 12:
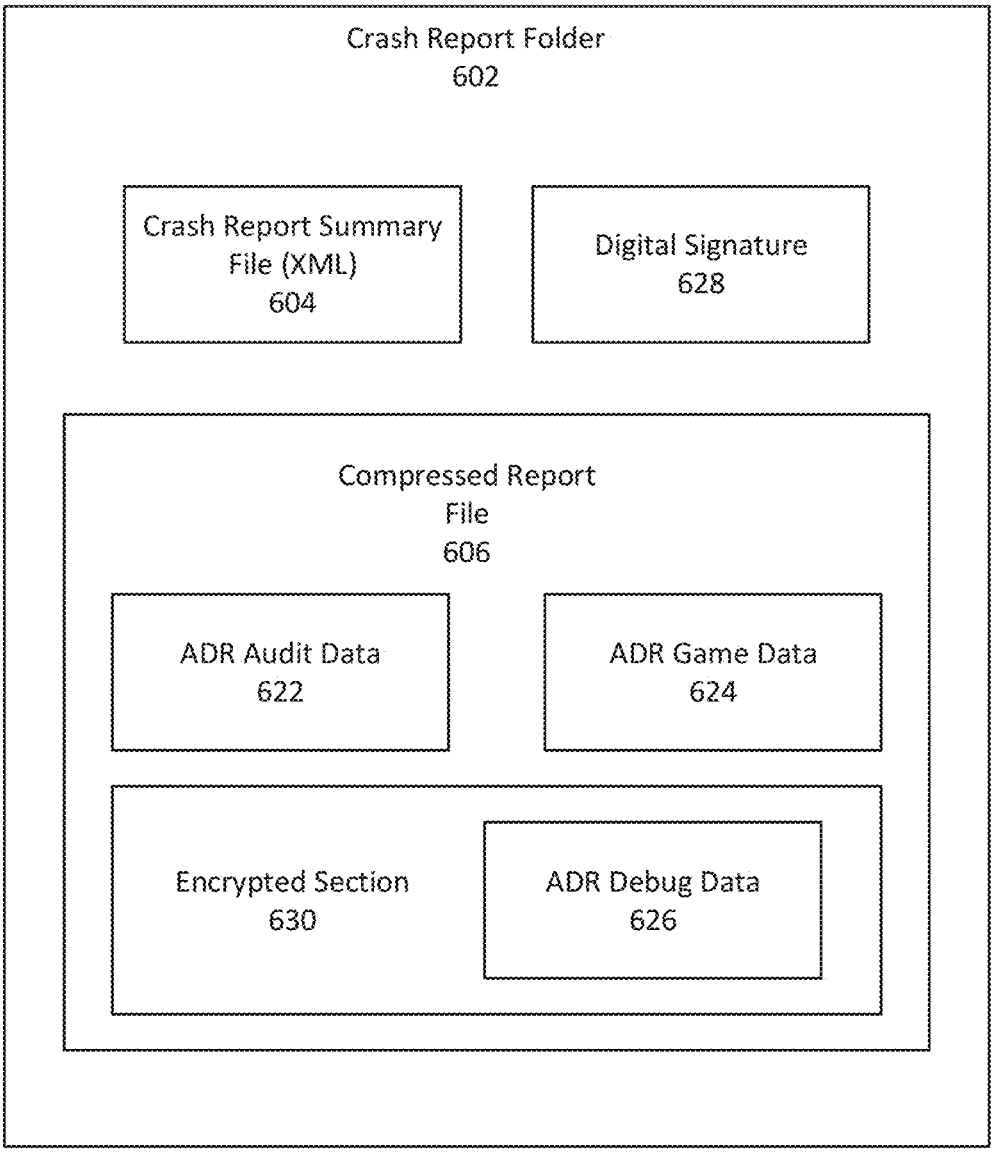
FIG. 12 is a block diagram illustrating contents of a crash report folder according to further embodiments.

In some embodiments, the ADR data in the compressed report file 606 may be segregated as shown in FIG. 12 into ADR audit data 622, ADR game data 624 and ADR debug data 626. As shown in FIG. 12, some of the data may be encrypted by the crash report manager module 804 and/or a monitored application 420, for example, using a public encryption key, within an encrypted section 630 of the compressed report file 606, so that the encrypted data can only be read by an intended recipient, such as a game manufacturer. It will be appreciated that the encrypted section 630 may be provided within the compressed report file 606 as shown in FIG. 12 or outside the compressed report file 606.

As further illustrated in FIG. 12, the crash report folder 602 may include a digital signature 628 that is generated based on the compressed report file 606 including or in addition to the encrypted section 630. As is well known in the cryptographic field, a digital signature 628 is generated using a private encryption key and can be verified using the corresponding public encryption key to verify the integrity of the signed information, which in this case includes the ADR data.

Screenshot Generation

One or more screenshots of images displayed on a primary and/or secondary display of the EGM may be captured and included as part of the ADR report. The captured screenshot(s) may include still images and/or video, and may include 2D representations of 3D images that were displayed on a display unit of the EGM. At least one screenshot may be provided that reproduces a screen that shows the outcome of a game instance that was executing on the EGM when the error condition occurred. The capturing of screenshots and generation of ADR data is described in more detail below.

The screenshot may include a video, a 3D rendering or a 2D rendering displayed on the display screen during an instance of the wagering game that was executing when the error condition occurred.

Figure 13A:
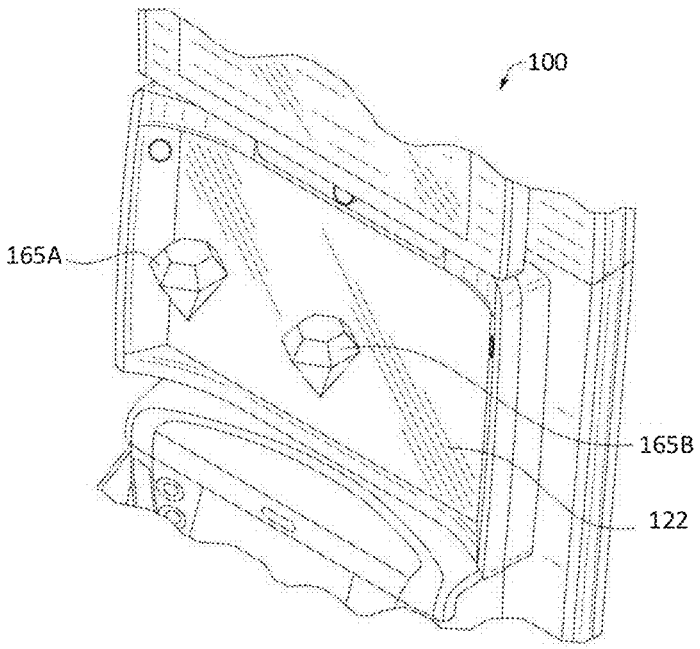
FIG. 13A is a perspective view of a three-dimensional display screen of an EGM according to some embodiments.
Figure 13B:
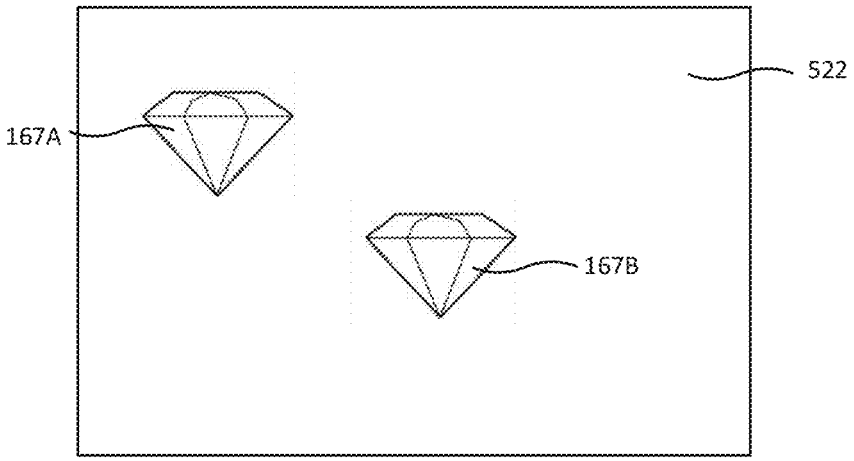
FIG. 13B illustrates a two-dimensional screenshot of the three-dimensional image displayed in FIG. 13A.

Generating the screenshot may include rendering a flat 2D view of a 3D scene displayed on the display screen. For example, FIG. 13A illustrates an EGM 100 including a three-dimensional display 122 that displays three dimensional objects 165A, 165B to a player before, during or after a game. FIG. 13B shows a screenshot 522 of the image shown in FIG. 13A. The screenshot 522 may be generated by the crash report manager module 804 automatically or in response to a command from the central server. When the screenshot 522 is generated of the screen on which the three dimensional objects 165A, 165B are displayed, the three dimensional objects 165A, 165B may be rendered as two-dimensional objects 167A, 1676 in the screenshot 522, for example, by projecting the three dimensional objects 165A, 165B onto a plane parallel to the plane of the display 122.

In some embodiments, a plurality of screenshots may be generated showing different screen data displayed on the display screen at different times near the time the error condition was detected. For example, immediately after an error condition is detected, the crash report manager module 804 and/or the monitored application 420 may generate a screenshot showing what was on the screen at the moment the crash was detected. The application may then show an error screen or game outcome screen indicating that an error has occurred. The crash report manager module 804 and/or the monitored application 420 may generate an additional screenshot showing the error screen or game outcome screen.

Figure 14:
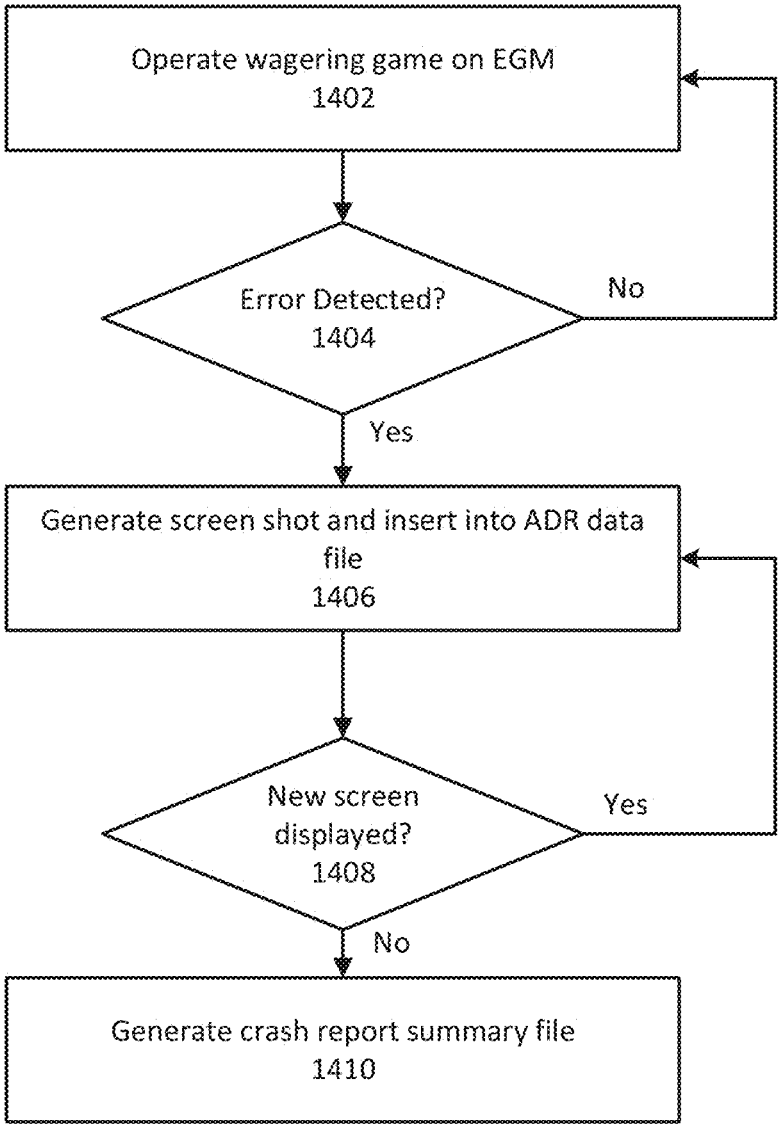
FIGS. 14 and 15 are flowcharts illustrating operations of systems/methods according to some embodiments.

Referring to FIG. 14, the operations may include operating a wagering game on an EGM (block 1402). The monitored game application 420 and/or the crash report monitor module 804 continuously checks to see if an error condition has occurred (block 1404). If not, the game application continues to operate. If an error condition is detected, the monitored game application 420 and/or the crash report monitor module 804 immediately generates a screenshot showing what was displayed on the display screen at the time the error condition was detected (1406) and the crash report monitor module 804 inserts the screenshot into an ADR file. The monitored game application 420 and/or the crash report monitor module 804 determines if another screen, such as a game outcome or error screen has been displayed on a display screen of the EGM 100 following the crash (block 1408), and if so, operations return to block 1406 and another screenshot of the new screen is captured. If no new screen is displayed, the crash report monitor module 804 generates the crash report summary file 604 (FIG. 6).

At least one of the plurality of screenshots may include screen data displayed before the error condition was detected. For example, in some embodiments, screenshot data may be continuously recorded in a buffer as the wagering game is played. When the buffer is full, screenshot data may be discarded if an error condition has not been detected at or near the time the screenshot data was captured. When an error is detected, the screenshot data may thereby include screenshot data showing the state of the game for a period of time before the error was detected.

Figure 15:
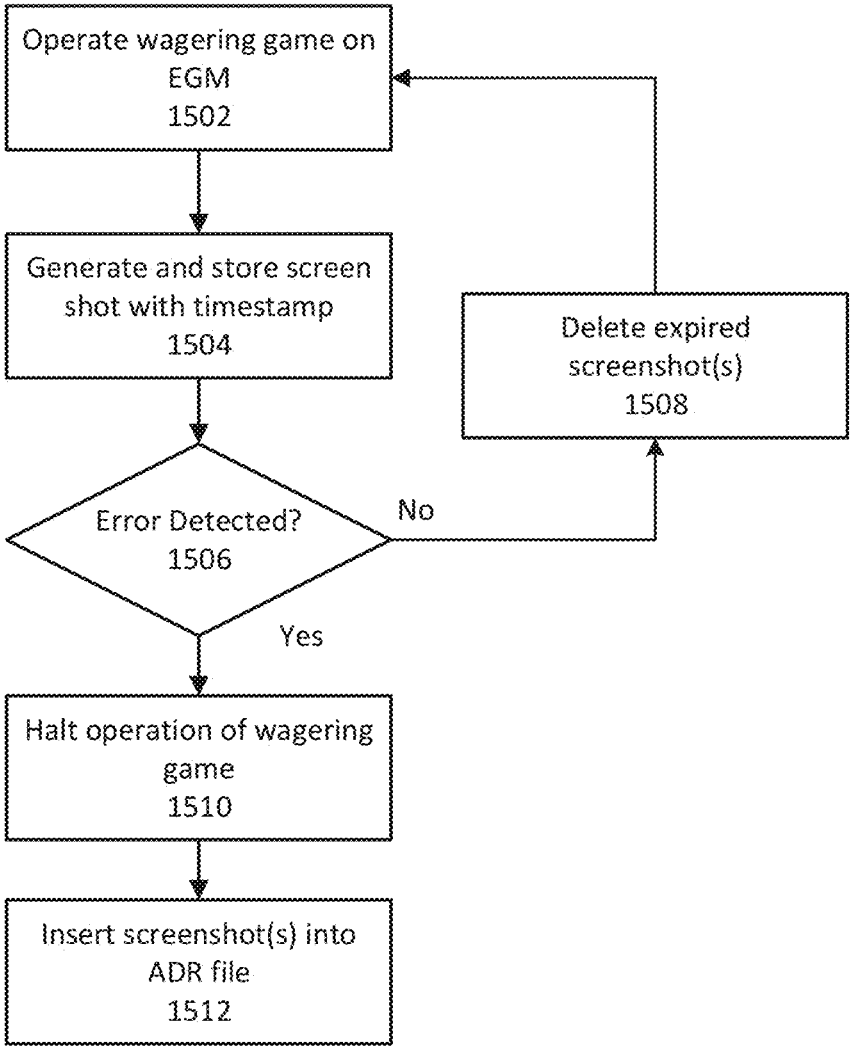

These operations are illustrated in FIG. 15. As shown therein, the operations may include operating a wagering game on an EGM 100 (block 1502). From time to time as the wagering game is being conducted, the wagering game and/or the crash report monitor module 804 generates a screenshot showing information displayed by the EGM on a display screen (block 1504). A timestamp may be generated and associated with the screenshot. For example, a file name of the screenshot may include a timestamp showing when the screenshot was created. Screenshots may be generated at regular intervals and/or in response to particular game events, such as wins, losses, bonus events, etc. If the wagering game and/or the crash report monitor module 804 does not detect an error condition, for example, within a given period of time, the wagering game and/or the crash report monitor module 804 may check all saved screenshots and delete any screenshot that has expired, i.e., that is older than a predetermined threshold time (block 1508), and operations continue at block 1502.

If an error condition is detected, the wagering game and/or the crash report monitor module 804 may halt or abort operation of the wagering game (block 1510) and insert any of the generated screenshots that have not expired into an ADR file (block 1512).

The stored screenshot data may be discarded upon conclusion of an instance of the wagering game if an error condition was not detected in association with the instance of the wagering game. At least one of the screenshots in the screenshot data may display a final outcome of an instance of the wagering game that was executing when the error condition occurred.

A log of screenshot data associated with an instance of the wagering game may be generated, and the log of screenshot data may be transmitted to the central server in the ADR data file.

In some embodiments, when the ADR data file and screenshot data are generated, the EGM may trigger a G2S_DLE301 Module Added event. The crash report manager module 804 may transmit the G2S_DLE301 Module Added event to the central server. In some embodiments, the G2S_DLE301 Module Added event may be triggered after triggering of a G2S GPE112 Game Ended event.

In some embodiments, the crash report manager module 804 may trigger a G2S_ADE201 Screenshot Capture Created event after generating the screenshot and transmit the G2S_ADE201 Screenshot Capture Created event to the central server.

A screenshot may be generated automatically by a wagering game and/or the crash report monitor module 804 or may be generated in response to a command from the central server. For example, in some embodiments, the EGM may notify the central server of an error condition, and the central server may issue a command to the EGM to generate the ADR data file including a screenshot in response to the error condition. The EGM then generates the ADR data file including the screenshot in response to the command from the central server.

In some embodiments, game outcome logs may be generated and stored for all instances of wagering games executed on the EGM regardless of whether an error condition occurred in a given instance of the wagering game.

Further Embodiments and Definitions

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on one or more computer storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing apparatus on data stored on one or more computer-readable storage devices or received from other sources.

The term "client" or "server" include all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube), LCD (liquid crystal display), OLED (organic light emitting diode), TFT (thin-film transistor), plasma, other flexible configuration, or any other monitor for displaying information to the user and a keyboard, a pointing device, e.g., a mouse, trackball, etc., or a touch screen, touch pad, etc., by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending webpages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

What is claimed is:

1. A method of generating crash reports in an electronic gaming machine (EGM) comprising a display screen, the method comprising:

generating a plurality of graphical screenshots of a screen displayed on the display screen at a plurality of times;

detecting an error condition during operation of a wagering game on the EGM, wherein the error condition affects operation of the wagering game executed on the EGM;

determining that a first graphical screenshot of the plurality of graphical screenshots corresponds to a screen displayed on the display screen within a first predetermined amount of time before the error condition;

generating an accident data file comprising log data related to the error condition and the first graphical screenshot;

transmitting a notification to a central server indicating that the accident data file was generated;

receiving a command from the central server to transmit the accident data file; and transmitting the accident data file comprising the log data and the first graphical screenshot to the central server using a secure communications network to which the EGM and the central server are connected.

2. The method of claim 1, further comprising:

determining that a second graphical screenshot of the plurality of graphical screenshots was displayed on the display screen within a second predetermined amount of time after the error condition, wherein the accident data file further comprises the second graphical screenshot.

3. The method of claim 1, further comprising:

continuously generating the plurality of graphical screenshots as the wagering game is played; and automatically discarding a graphical screenshot of the plurality of graphical screenshots after a second predetermined amount of time after the graphical screenshot data was generated in response to determining that an error condition was not detected within the second predetermined amount of time.

4. The method of claim 1, further comprising:

automatically discarding a graphical screenshot of the plurality of graphical screenshots upon conclusion of an instance of the wagering game associates with the graphical screenshot in response to determining that an error condition was not detected in association with the instance of the wagering game.

5. The method of claim 1, further comprising:

generating a log of graphical screenshot data associated with an instance of the wagering game, and transmitting the log of graphical screenshot data to the central server.

6. The method of claim 1, wherein transmitting the accident data file and the first graphical screenshot to the central server comprises transmitting the accident data file and the first graphical screenshot to the central server using a game-to-system communication protocol message structure.

7. The method of claim 6, further comprising:

triggering a G2S_DLE301 Module Added event in response to generating the accident data file and the first graphical screenshot and transmitting the G2S_DLE301 Module Added event to the central server.

8. The method of claim 7, wherein the G2S_DLE301 Module Added event is triggered after triggering of a G2S_GPE112 Game Ended event.

9. The method of claim 7, further comprising, in response to generating the accident data file, triggering a G2S_ADE201 Screenshot Capture Created event after generating the first graphical screenshot and transmitting the G2S_ADE201 Screenshot Capture Created event to the central server.

10. The method of claim 6, further comprising:

in response to detecting the error condition, storing the accident data file and the first graphical screenshot in nonvolatile storage prior to transmitting the accident data file and the first graphical screenshot to the central server.

11. The method of claim 1, wherein the first graphical screenshot displays a final outcome of an instance of the wagering game that was executing before the error condition occurred.

12. The method of claim 1, wherein the first graphical screenshot comprises a 3D rendering displayed on the display screen during an instance of the wagering game that was executing before the error condition occurred.

13. The method of claim 1, wherein generating the plurality of graphical screenshots further comprises, for each graphical screenshot:

generating a flat 2D view of a 3D scene displayed on the display screen during an instance of the wagering game.

14. The method of claim 1, further comprising generating and storing accident data files comprising graphical screenshots for all instances of wagering games executed on the EGM regardless of whether an error condition occurred in a given instance of the wagering game.

15. The method of claim 1, further comprising:

triggering a G2S_ADE100 event in response to detecting the error condition in the operation of the wagering game.

16. An electronic gaming machine (EGM), comprising:

a processor circuit;

a memory operably coupled to the processor circuit;

a display screen coupled to the processor circuit; and computer program instructions stored in the memory which, when executed, cause the processor circuit to:

detect an error condition during operation of a wagering game on the EGM, wherein the error condition affects operation of executed on the EGM;

generate an accident data file comprising log data related to the error condition and a first graphical screenshot corresponding to a screen displayed on the display screen within a first predetermined amount of time before the error condition;

transmit a notification to a central server indicating that the accident data file was generated;

receive a command from the central server to transmit the accident data file; and transmit the accident data file including the first graphical screenshot to the central server using a secure communications network to which the EGM and the central server are connected.

17. The EGM of claim 16, wherein the instructions further cause the processor circuit to:

continuously generate a plurality of graphical screenshots as the wagering game is played;

upon conclusion of an instance of the wagering game for which an error condition was not detected, automatically discard the graphical screenshots associated with the instance of the wagering game.

18. A method of generating crash reports in an electronic gaming machine (EGM) comprising a display screen, the method comprising:

generating a plurality of graphical screenshots of a screen displayed on the display screen;

for each graphical screenshot of the plurality of graphical screenshots, triggering a G2S_ADE201 Screenshot Capture Created event and transmitting the G2S_ADE201 Screenshot Capture Created event to a central server;

detecting an error condition during operation of a wagering game on the EGM, wherein the error condition affects operation of the wagering game on the EGM;

generating an accident data file comprising log data related to the error condition;

triggering a G2S_DLE301 Module Added event in response to generating the accident data file and transmitting the G2S_DLE301 Module Added event to the central server using a game-to-system communication protocol message structure over a secure communications network to which the EGM and the central server are connected;

receiving a command from the central server to transmit the accident data file;

in response to receiving the command from the central server, inserting a first graphical screenshot of the plurality of graphical screenshots into the accident data file, wherein the first graphical screenshot corresponds to a screen displayed on the display screen within a first predetermined amount of time before the error condition; and transmitting the accident data file comprising the log data and the first graphical screenshot to the central server.

* * * * *